United States Patent [19]

Haab

[11] Patent Number: 4,549,380

[45] Date of Patent: Oct. 29, 1985

[54] SEALING MEANS FOR WALL MEMBERS AND WALL MEMBER FOR PARTITION WALLS

[75] Inventor: Karl Haab, Ober Weidstrasse 7, Rotkreuz, Switzerland

[73] Assignee: Otto Haab, Mettmemstetten, Switzerland

[21] Appl. No.: 551,159

[22] Filed: Nov. 14, 1983

[30] Foreign Application Priority Data

Nov. 16, 1982 [CH] Switzerland ..... 6679/82

[51] Int. Cl.[4] ..... E04B 2/82

[52] U.S. Cl. ..... 52/240; 52/243.1; 160/40

[58] Field of Search ..... 52/126.3, 127.7, 235, 52/238.1, 239, 240, 243, 243.1; 49/317; 160/40

[56] References Cited

U.S. PATENT DOCUMENTS

| | | | |
|---|---|---|---|
| 2,929,445 | 3/1960 | Haws | 160/40 X |
| 3,072,975 | 1/1963 | Burmeister | 49/317 X |
| 3,295,257 | 1/1967 | Douglas | 49/317 X |
| 4,450,658 | 5/1984 | Legeai | 52/240 X |
| 4,462,192 | 7/1984 | Fisher | 52/243.1 |

FOREIGN PATENT DOCUMENTS

| | | | |
|---|---|---|---|
| 2065747 | 10/1975 | Fed. Rep. of Germany | 52/240 |
| 2736413 | 2/1979 | Fed. Rep. of Germany | 52/240 |
| 1397901 | 6/1975 | United Kingdom | 49/317 |

*Primary Examiner*—Donald G. Kelly
*Assistant Examiner*—Richard E. Chilcot, Jr.
*Attorney, Agent, or Firm*—Murray Schaffer

[57] ABSTRACT

A wall member is formed of a covered frame having upper and lower profiles and connecting lateral profiles. A seal is set in the edges of each of upper and lower profiles and is provided with means for raising and lowering the seal relative to the profile. The lateral profiles are provided with covers which extend beyond the upper and lower profiles. The covers are provided with recesses at the ends to enable seals to extend therethrough beyond the lateral profiles. A winch and cable system within the frame is provided to displace the seals.

9 Claims, 6 Drawing Figures

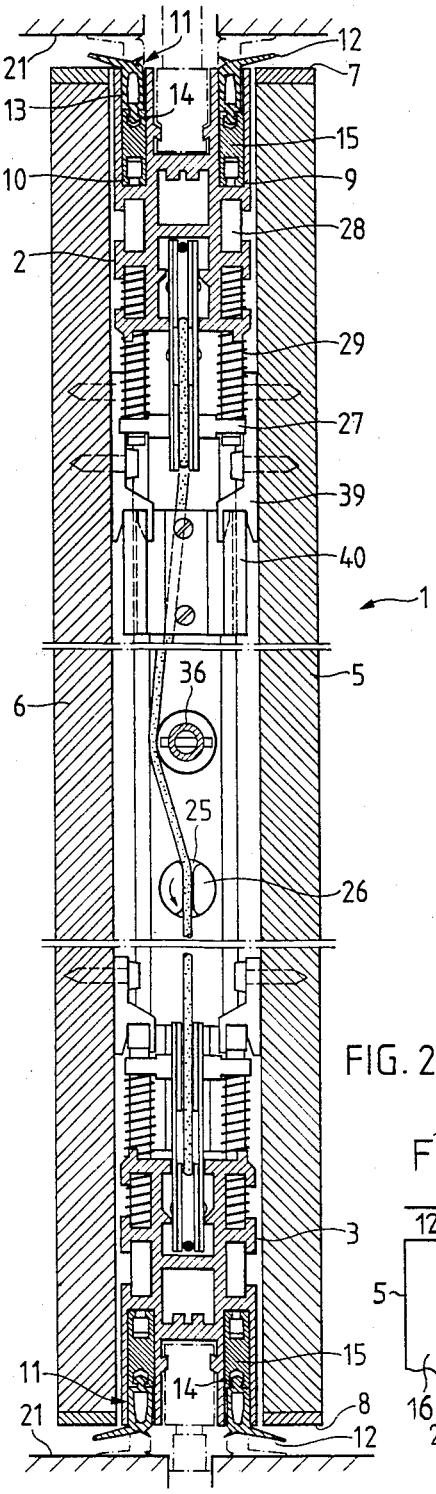
FIG. 2
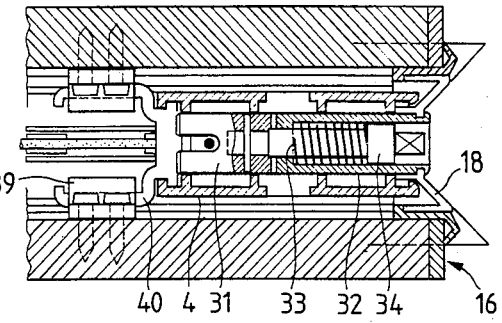
FIG. 3
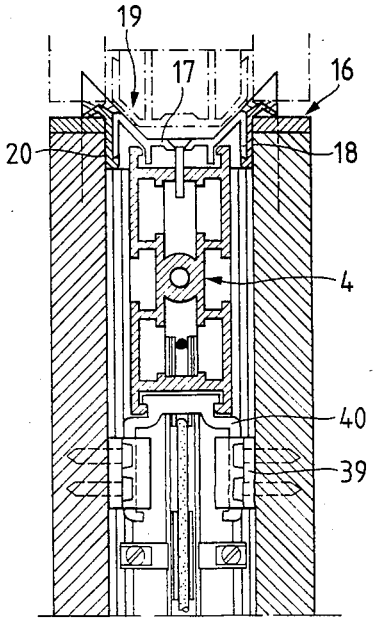
FIG. 4
FIG 6
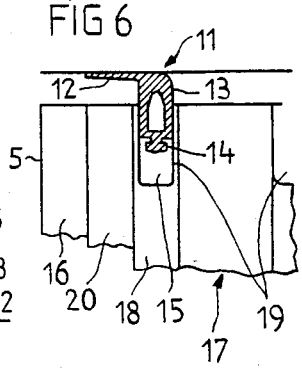
FIG. 5
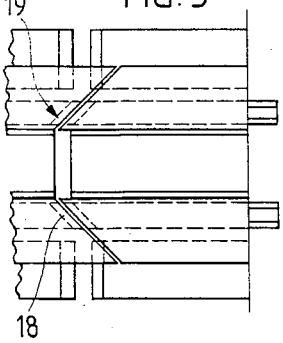

SEALING MEANS FOR WALL MEMBERS AND WALL MEMBER FOR PARTITION WALLS

BACKGROUND OF THE INVENTION

The invention relates to a sealing means for a wall member of partition walls, and in particular to a wall member having on its upper and lower edges a raisable and lowerable sealing strip.

In many applications partition walls are produced by joining together individual wall members. If the partition is to be removable, the wall members are displaceably mounted on running gears or on a chassis mounted on rails located in the ceiling. Prior to the removal of the partition wall, any fixing member must be released and the individual walls member then moved to a point provided for its removal. However, if the partition wall is not to be removed, the wall members are set up and fixed without any such chassis. The wall members of such installations suffer from the disadvantage that they can be installed only if they are somewhat smaller than the overhead clearance of the particular space, so that a gap is left behind after installation. This gap considerably reduces the sound damping action of the partition wall, even if the wall construction has a good soundproofing.

Wall members for partitions are known in which extendable sealing strips are provided on the upper and lower edge of each wall member (German Pat. No. 2,306,617). The wall member comprises a profile frame in which the sealing strips are displaceably mounted. As a closing or cover is normally provided on the lateral edge of the wall member, the sealing strip cannot be moved up to the butt joint between the respective upper and lower edge and the lateral edge. Thus, at this joint there is an untight or loose joint, which must be closed by an additional sealing insert, which is connected to the sealing strips. However, this arrangement is complicated and does not constitute an ideal sound-insulating solution, because the sound can pass freely through the gap existing at the sealing insert and at the sealing strips.

It has also been known to displace the sealing strips of the wall members, by means of a linkage, which engages in the center of the sealing strip. However, the disadvantage then exists that the sealing strips are non-uniformly compressed so that the sealing of the gap is not reliably ensured.

It is an object of the invention to so construct a sealing means for wall members, that a simple and effective sound insulation is obtained at the sealing strips, and the butt joints.

SUMMARY OF THE INVENTION

According to the invention, this problem is solved in that the sealing strip extends through a recess provided in the cover in the vicinity of the butt joint of two end faces.

A wall member having the sealing means according to the invention provides a simple solution which also avoids jamming and tilting. For the displacement of the sealing strip on the upper and lower end face of the frame, a cable is guided over a pulley system within the frame which includes a winch. The cable guided between two pulleys about a lifting pulley, the latter being connected to the sealing strip and displaceable therewith.

BRIEF DESCRIPTION OF THE DRAWINGS

The invention is described in greater detail hereinafter relative to non-limitative embodiments and attached drawings, wherein:

FIG. 2 is a section through the wall member according to FIG. 1, along line II—II of FIG. 1;

FIG. 3 is a horizontal section fo the wall member along line III—III of FIG. 1;

FIG. 4 is another horizontal section of the wall member along line IV—IV of FIG. 1;

FIG. 5 is view of the sealing means of the wall member from direction V in FIG. 1 and showing its abuttment with an adjacent wall member; and FIG. 6 is a partial view of the sealing arrangement of the wall member from direction VI in FIG. 1.

DETAILED DESCRIPTION OF THE INVENTION

Figure 1:
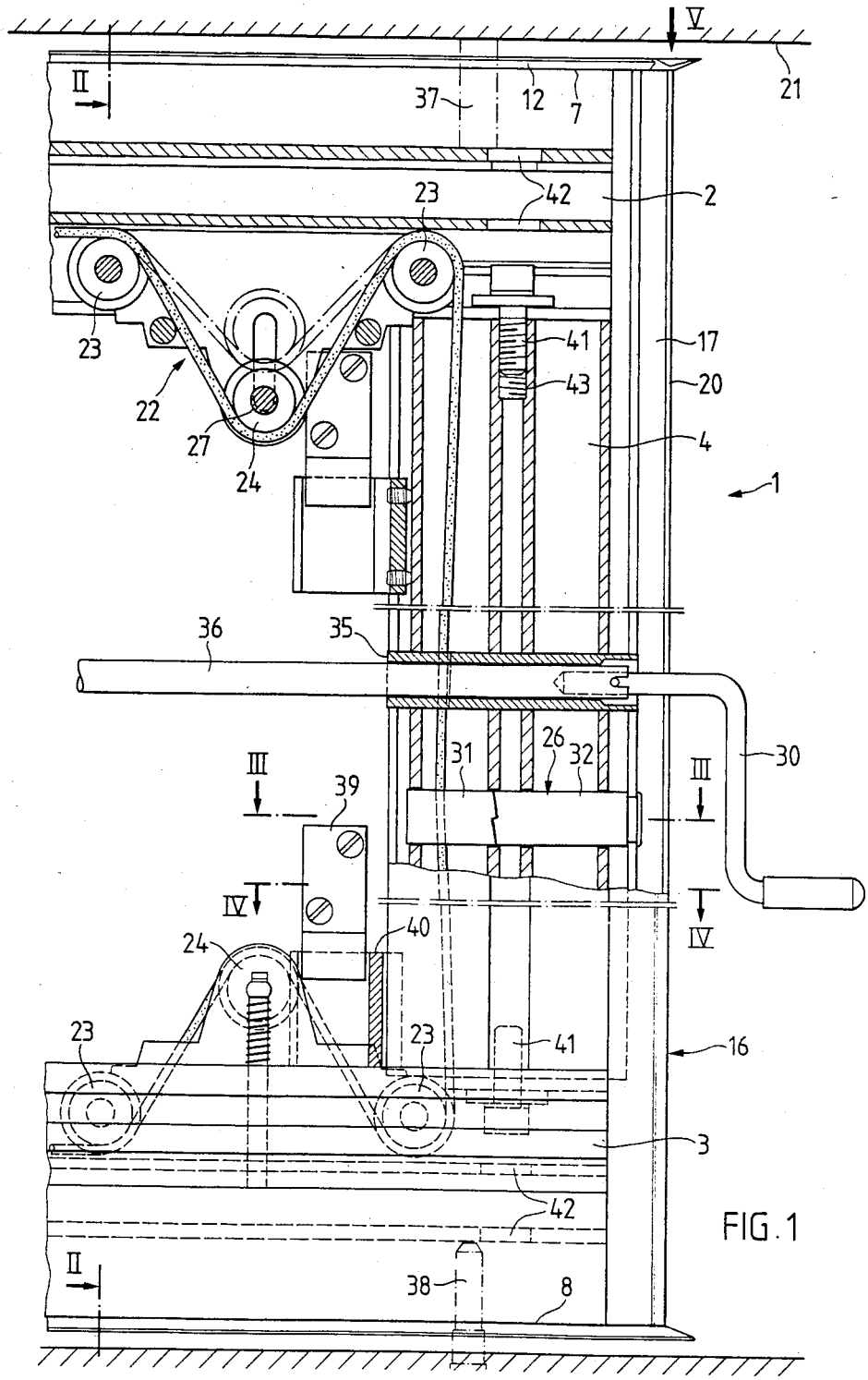
FIG. 1 is a side elevation view of a partly sectioned shown wall member.

The wall member 1 shown in FIGS. 1 and 2 has a rectangular frame, which is formed of metal channel members consisting of upper and lower profiles 2, 3 having the same cross sections and two lateral profiles 4 (only one of which is visible). The profiles 4 have the same cross-section, which, however, differs from that of the upper and lower profiles 2, 3, of FIG. 4. The frame formed from these profiles 2, 3, 4 is covered by two wall panels 5, 6 (FIG. 2), which are, for example, chipboards.

The upper and lower profiles 2, 3 have two grooves 9, 10 opening in the direction of the upper and lower end faces 7, 8 respectively. An elongated sealing strip 11 is placed in each of the grooves 9, 10 so that they can be raised from the groove respectively, in a manner to be described hereinafter.

The sealing strip 11 comprises in cross-section a sealing lip 12 projecting laterally over groove 9, or groove 10 as the case may be and an integrally formed web constructed as a hollow body 13. At its free lower edge the body 13 is formed with a profiled head 14, by which the body 13 is connected to a guide strip 15 which extends in the same way as sealing strip 11 over the entire width of wall member 1.

It can be gathered from FIGS. 3 and 4 that the lateral, outer face 16 of the metal profile 4 is covered by a shaped cover 17 which extends up to the upper or lower end face 7, 8 of the frame, of FIG. 1. Normally, the sealing strip 11 could thus not extend beyond the lateral face 16. However, in order to make this possible, the cover 17 is provided with a lateral arm 18 in which a recess 19 is formed in the vicinity of the upper and lower faces 7, 8 respectively, through which the sealing strip 11 projects somewhat over the lateral end face 16. The recess 19 need not be so large that the guide strip 15 also extends beyond the lateral face 16. It is in fact sufficient if recess 19 conforms to the cross-section of body 13 and only the latter extends over the lateral face 16.

While the cover 17, according to FIGS. 3 and 4, has a concave configuration, the cover for the opposite lateral end face 16 and/or of the abutting end face of adjacent connected wall member 1 is convex so that the abutting edges fit within each other. Sealing strips 11 are correspondingly constructed, of FIG. 5. FIG. 5, also shows how the ends of the sealing strips 11 project somewhat over the lateral arms 18 of the concave and convex cover 17, so that a good sealing covering is also obtained at this point on sliding together two adjacent wall members 1. The portion of the sealing strip 11 projecting over the lateral arms 18 of cover 17 can be made sufficiently large that any gap between adjacent wall members 1 are covered as a result of any soft packing 20 installed along the edge 16 with the cover 17, of FIG. 4.

The construction of body 13 of the sealing strip 11 as a hollow body has the advantage that if the raised sealing lip 12 rests on the associated sealing surface 21, the body 13 presses against the walls of the U-shaped groove 9, 10 and in this way reliably prevents the transmission of sound.

The raising of the sealing strip 11 and its compression against sealing surface 21 takes place by means of a cable system including a cable 22 which may be metal or plastic guided between two pulleys 23 over a lifting pulley 24 in arrangement with each of the upper and lower profiles. The use of a cable 22 makes it possible to arrange two or more lifting pulleys 24 and guide pulleys 23 over the width of wall member 1 so that a uniform raising and lowering of sealing strip 11 may be effected. The ends of cable 22 are fixed, in a manner not shown, to the frame and are guided through a groove 25 of a winch 26. By turning winch 26, the overall length of cable 22 is reduced, being wound onto winch 26. As a result of the shortening of the cable, lifting pulleys 24 are raised, see the broken line position in FIG. 1, so that the sealing strip 11 is raised against the sealing surface 21. Lifting pulleys 24 is mounted on a shaft 27, which is supported on push rods 28. The push rods 28 are connected to the guide strips 15 and are also under the action of springs 29, which normally bias the push rods 28 and consequently the guide strips 15 away from the sealing surfaces 21.

Winch 26, which can be operated from the lateral face 16, by means of a crank 30, is constructed of two shaft parts 31 and 32 which are coupled by cams acting in one direction. The two shaft parts 31, 32 are held together by a spring 33 arranged in the interior and which presses onto a bolt 34 located in the shaft part 32 and connected with shaft part 31. Above the winch 26 there is fixed a pipe length 35 in the lateral metal profile 4. A rod 36 projects through the pipe with which an assembly pin, not shown, on the opposite lateral profile 4 can be screwed into the lateral metal profile 4 of an adjacent wall member 1, so that the lateral faces 16 of a pair of adjacent wall members 1 can be made to engage tightly with one another. The same crank 30 may be used to manipulate the rod 36, as shown in FIG. 1.

The wall member 1 shown in FIG. 1 is mounted so as to travel along the ceiling on chassis, not shown, by means of hangar pins 37. In the same way, at the bottom, a pilot pin 38 is provided.

On the inside surface of the wall panels 5, 6 tie plates 39 are provided which are hooked onto support profiles 40, which are secured on the lateral metal profile 4 to extend within the interior of the rectangular frame (FIGS. 3 and 4).

Metal profiles 2, 3, 4 are assembled and connected by means of screws 41, for which purpose openings 42 are provided in the upper and lower metal profiles 2, 3 whilst a thread 43 is provided in lateral metal profile 4.

Cable 22 permits the arrangement of several lifting pulleys 24, so that over the entire width of wall member 1, sealing strips 11 can be uniformly pressed onto the upper and lower sealing surface 21.

Through the use of cable 22, the inner area remains free, i.e. rod 36 may be removed and the joining of the wall members 1 may be brought about in some other way, e.g. by the joint compression of all the wall members 1 of a complete wall, so that in the vicinity of the free inner space the wall panels can be replaced by glass panels. Here again, the good sound insulation achieved through the uninterrupted sealing of the sealing strips 11 is maintained.

As a result of the described sealing arrangement, wall member 1 has an excellent sound damping action, which can, in particular, be attributed to the fact that there are no direct connections, particularly in the critical area of the abutting sealing strips 11, due to the projecting ends of the latter.

What is claimed is:

1. A wall member for abutting multimember partition walls, comprising a rectangular frame covered on each face by a wall panel, said frame having upper and lower profiles and a pair of connecting lateral profiles, the outer edges of each of said upper and lower profiles having at least one groove in which is mounted a seal capable of being raised and lowered with respect to the profile into contact with a spaced surface, the outer edges of each of said lateral profiles being provided with a cover fixed thereto extending above and below the outer edge of said upper and lower profile respectively, said cover having a recess at its upper and lower ends through which said seals extend, and means for displacing said seals comprising a cable attached at each end to said frame, a winch mounted within said frame for winding said cable, a pulley secured to each of said seals respectively and over which said cable is entrained to selectively displace said seals between a lifted position and a lowered position on operation of said winch.

2. The wall member according to claim 1 including means for resiliently biasing said seal means in its lowered position.

3. The wall member according to claim 1 wherein said winch is mounted on one of said lateral profiles, and is provided with a crank extending through an opening in the associated cover.

4. The wall member according to claim 3 wherein said winch comprises a pair of axially aligned shaft parts coupled by unidirectional cam means, said shaft parts being axially separable.

5. The wall member according to claim 1 wherein one lateral profile is provided with a concave cover and the other lateral profile is provided with a conformingly convex cover, and the corresponding seal means extending through said covers are conformingly convex and concave so that two wall members may be closely abutted.

6. The wall member according to claim 1 including means for fastening abutting wall members together comprising a threaded bolt located in one of said lateral profile and a recess located in said opposite profile conforming thereto, and means for manipulating said bolt comprising an elongated rotatable rod extending through said frame from said opposite lateral profile.

7. The wall member according to claim 1 wherein said seal comprises a resilient profile member having a hollow body having a lip integrally formed therewith and extending outwardly therefrom, said body being secured to an elongated substantially rigid guide strip and being set in the associated groove of the upper and lower profile.

8. The wall member according to claim 1 wherein said recess for said seal has a cross-section conforming to the body of said seal and said body extends through said recess free of said guide strip.

9. The wall member according to claim 8 including a push rod connecting said lifting pulley to said guide strip, and a spring biasing said push rod away from the associated one of said upper and lower profile.

* * * * *